US005386475A

United States Patent [19]

Birck et al.

[11] Patent Number: 5,386,475

[45] Date of Patent: Jan. 31, 1995

[54] REAL-TIME HEARING AID SIMULATION

[75] Inventors: Jonathan D. Birck; Grayson C. Silaski, both of Portland, Oreg.

[73] Assignee: Virtual Corporation, Portland, Oreg.

[21] Appl. No.: 981,749

[22] Filed: Nov. 24, 1992

[51] Int. Cl.[6] ..... H04R 25/00

[52] U.S. Cl. ..... 381/68; 381/60; 128/746

[58] Field of Search ..... 381/68.2, 68.4, 60, 381/94, 68; 128/746; 73/585

[56] References Cited

U.S. PATENT DOCUMENTS 3,922,506 11/1975 Frye .
4,065,647 12/1977 Frye et al. .
4,471,171 9/1984 Köpke et al. ..... 381/60
4,759,070 7/1988 Voroba et al. .
4,809,708 3/1989 Geisler et al. ..... 128/746
4,868,880 9/1989 Bennett, Jr. ..... 381/68.2
4,870,688 9/1989 Voroba et al. .
4,879,749 11/1989 Levitt et al. .
4,901,353 2/1990 Widin .
4,953,112 8/1990 Widin et al. .
4,992,966 2/1991 Widin et al. .
5,029,217 7/1991 Chabries et al. ..... 381/68.2

FOREIGN PATENT DOCUMENTS 2844218 4/1980 Germany .

*Primary Examiner*—Curtis Kuntz
*Assistant Examiner*—Huyen D. Le
*Attorney, Agent, or Firm*—Smith-Hill and Bedell

[57] ABSTRACT

A hearing aid is fitted to a patient by first creating a filter having a frequency response dependent on the product of the frequency response of a target hearing aid and the inverse frequency response of a master hearing prosthesis that includes a microphone and an electro-acoustic transducer. The patient is then equipped with the master hearing prosthesis and the microphone of the master hearing prosthesis is exposed to an input acoustic signal, whereby the microphone generates an electrical signal. The electrical signal is processed by the filter and the filtered electrical signal is applied to the electro-acoustic transducer, whereby the patient receives an acoustic signal representative of the input acoustic signal modified by the transfer function of the filter.

14 Claims, 3 Drawing Sheets

REAL-TIME HEARING AID SIMULATION

BACKGROUND OF THE INVENTION

This invention relates to hearing aids and more particularly to a method of fitting a hearing aid and to real-time hearing aid simulation.

Dispensing of hearing aids according to current practice is performed by audiologists or licensed hearing aid dispensers in accordance with a set procedure. First, an audiogram is recorded in a sound room by providing a pure tone to a patient at various frequencies, one at a time, at ever-decreasing amplitudes. The patient acknowledges the presence of the tone with a raised finger or hand. By employing this technique, the patient's hearing threshold is recorded across a frequency range of, for example, 125 Hz to 8000 Hz. In addition to the pure tone tests, a patient may be tested with speech stimulus to give an indication of what percentage of words the patient recognizes at a given signal level, or to determine the threshold of speech recognition. Once the hearing threshold and speech recognition threshold are determined, the audiologist reviews data describing the frequency response and amplification characteristics of various models of hearing aids, selects a particular hearing aid having characteristics which the audiologist determines would be most likely to provide improved hearing for the patient, and orders a unit of the selected hearing aid. The audiologist also takes an impression of the patient's ear and orders an ear mold of the proper shape and size to fit the patient's ear. The custom ordered hearing aid is fitted to the custom ordered ear mold, and is then ready for use by the patient.

In the United States, approximately 20% of all hearing aids that are dispensed by audiologists and hearing aid dispensers are returned because the patient is not satisfied. This might be because the patient's only involvement in the selection procedure is in the steps of determining the hearing and speech recognition thresholds.

It is known to employ a master hearing aid in fitting a patient with a target hearing aid. The master hearing aid is similar to a conventional hearing aid but includes a simple electronic filter that is intended to allow the master hearing aid to emulate a particular target hearing aid. However, such a master hearing aid only approximates the response of the target hearing aid since the actual response of the signal path that includes the target hearing aid is affected by a number of factors other than the frequency response of the hearing aid. For example, the hearing aid is held within the patient's ear by an ear mold, and the ear mold has vents that influence the acoustic signal that is generated in the patient's ear cavity.

SUMMARY OF THE INVENTION

In accordance with a first aspect of the present invention there is provided a method for fitting a hearing aid to a patient comprising the steps of creating a filter having a frequency response dependent on the product of the frequency response of a target hearing aid and the inverse frequency response of a master hearing prosthesis that includes a microphone and an electro-acoustic transducer, equipping the patient with the master hearing prosthesis, exposing the microphone of the master hearing prosthesis to an input acoustic signal, whereby the microphone generates an electrical signal, and filtering said electrical signal with said filter and applying the filtered electrical signal to the electro-acoustic transducer, whereby the patient receives an acoustic signal representative of the input acoustic signal modified by the frequency response of the filter.

In accordance with a second aspect of the present invention there is provided a method of characterizing the relative performance of first and second hearing prostheses each comprising a microphone, an amplifier and a speaker, said method comprising (a) connecting the first hearing prosthesis in a signal path between an electro-acoustic transducer and an acousto-electric transducer, (b) applying an electrical signal to the electro-acoustic transducer, whereby the acousto-electric transducer generates an electrical signal that depends on the signal path including the first hearing prosthesis, (c) correlating the electrical signal generated by the acousto-electric transducer in step (b) with the signal applied to the electro-acoustic transducer in step (b) to derive the transfer function of the signal path including the first hearing prosthesis, (d) connecting the second hearing prosthesis in the signal path between the electro-acoustic transducer and the acousto-electric transducer, (e) applying an electrical signal to the electro-acoustic transducer, whereby the acousto-electric transducer generates an electrical signal that depends on the signal path including the second hearing prosthesis, and (f) correlating the electrical signal generated by the acousto-electric transducer in step (e) with the signal applied to the electro-acoustic transducer in step (e) to derive the transfer function of the signal path including the second hearing prosthesis.

In accordance with a third aspect of the present invention there is provided an apparatus for simulating the performance of a target hearing aid, comprising a master hearing prosthesis having a microphone and an electro-acoustic transducer, and a filter having a transfer function substantially equal to the product of the transfer function of a signal path including the target hearing aid and said signal path including the master hearing prosthesis in lieu of the target hearing aid, said filter being connected between the microphone of the master hearing prosthesis and the electro-acoustic transducer thereof, whereby the combined transfer function of the master hearing prosthesis and the filter is substantially equal to the transfer function of the target hearing aid.

BRIEF DESCRIPTION OF THE DRAWINGS

For a better understanding of the invention, and to show how the same may be carried into effect, reference will now be made, by way of example, to the accompanying drawings, in which.

DETAILED DESCRIPTION

Figure 1:
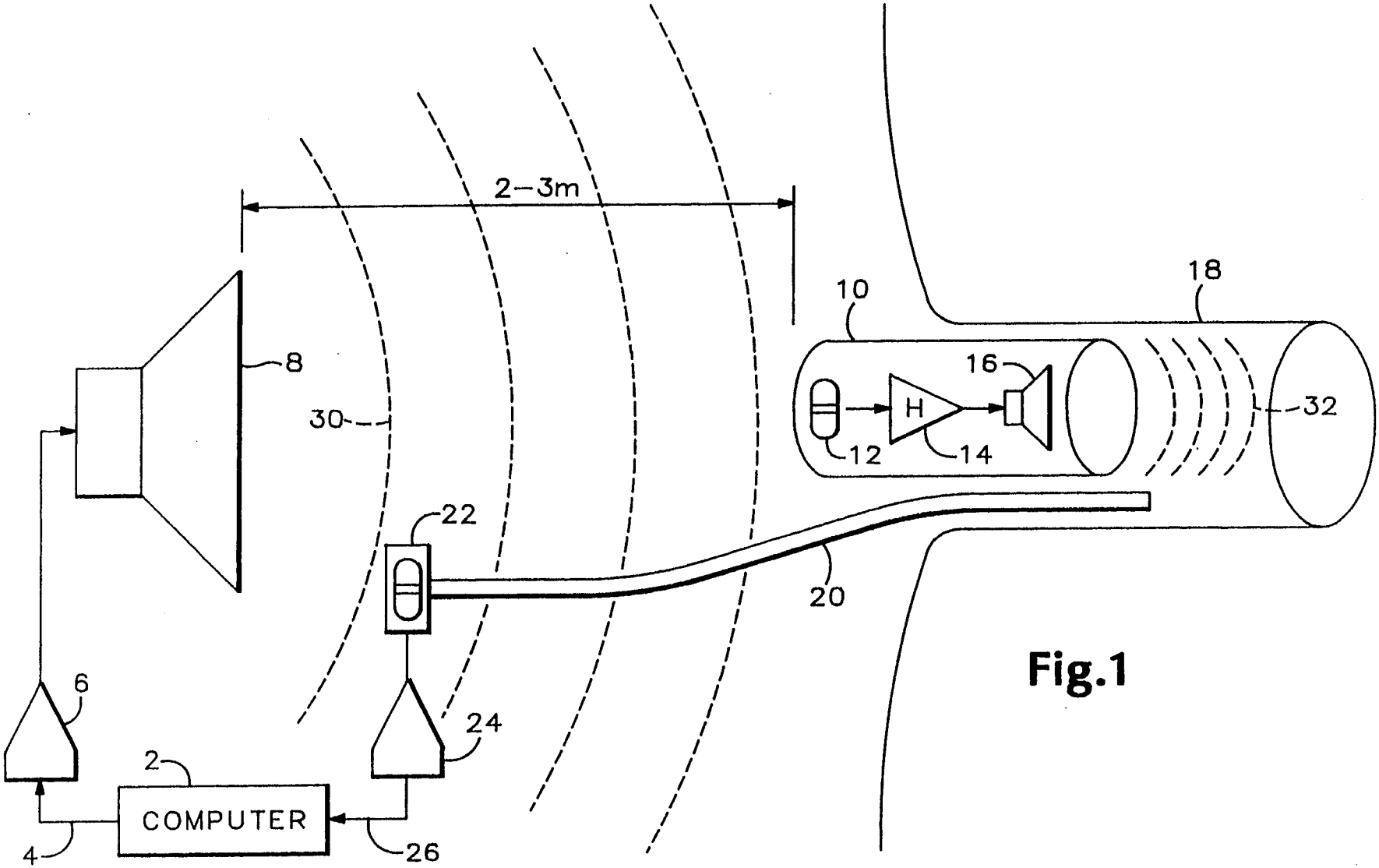
FIG. 1 is a diagram illustrating characterization of a particular hearing aid.

Referring now to FIG. 1, a general purpose digital computer 2 has an output port 4 connected to a digital to analog (D/A) converter 6, whose output is connected to a sound field speaker 8. Speaker 8 is spaced at a distance of 2–3 m from a target hearing aid 10. The hearing aid 10, which comprises a microphone 12 supplying amplifier 14 and the output of amplifier 14 supplying receiver 16, is placed within a so-called coupler 18, such as a 2 ml coupler, which simulates an ear. Also inserted into the coupler, along with the hearing aid, is one end of a tube 20 of silicone rubber material. The interior space of tube 20 is in open communication with the interior of the coupler. The opposite end of the tube 20 is connected to a an acousto-electric transducer 22, such as a condenser microphone. The tube 20 propagates an acoustic signal that exists in the coupler to transducer 22, which generates an electrical signal that is applied to an analog to digital (A/D) converter 24, whose output is connected to an input port 26 of computer 2.

In order to characterize the signal path that includes the hearing aid 10, the computer 2 generates a pseudo-random sequence of digital words. The pseudo-random sequence of digital words is applied to D/A converter 6, which generates an analog output signal. The sequence of digital words is such that the analog signal is a white noise signal that contains a broad spectrum of audio frequencies, typically from 125 Hz to 8,000 Hz, and has a duration of 500 ms. Alternatively, the sequence of digital words may be chosen to generate an analog signal comprising a composite of a number of pure tones. The analog signal drives the sound field speaker 8 to emit an acoustic signal 30 toward the target hearing aid 10. The acoustic signal is received by the hearing aid 10 and converted into an electrical signal by hearing aid microphone 12 and, when amplified by amplifier 14, is provided by receiver 16 as an amplified acoustic signal 32 in the interior of the coupler 18. The tube 20 propagates the acoustic signal 32 to transducer 22 which generates an electrical signal that is digitized by A/D converter 24. Preferably, A/D converter 24 operates at a sampling frequency of 44.1 kHz and therefore acquires a sequence of 22,050 samples. In order to allow the system time to settle after start of the sequence of digital words generated by the computer, the first segment of the sequence of samples is discarded. Further, in order to reduce computation time, the remaining samples are decimated to provide a record containing 4,096 samples.

Time domain averaging may be employed to increase the signal to noise ratio before decimation. The averaging may be dependent on noise level. For example, averaging may be performed until the standard deviation at each sample point is less than 2 dB.

The computer 2 carries out a fast Fourier transform on the record of 4,096 samples to extract frequency information and the function returned by the fast Fourier transform is correlated with the frequency content of the broadband sequence generated by the computer 2 so as to provide a transfer function Ha(s) that is representative of the frequency response of the signal path from the output port 4 to the input port 26 and includes hearing aid 10. The function Ha(s) is stored in memory.

The transfer function Ha(s) depends on the sound field speaker 8, the room environment where the testing takes place, the target hearing aid 10 in the coupler 18, and tube 20 and transducer 22. Specifically, the transfer function Ha(s) is the product of the transfer functions of all components in the signal path from the output port 4 to the input port 26. Thus, if the transfer function of the target hearing aid is designated Ht(s) and the transfer function of the rest of the signal path is designated Hr(s), the transfer function Ha(s) is equal to Ht(s) * Hr(s).

Figure 2:
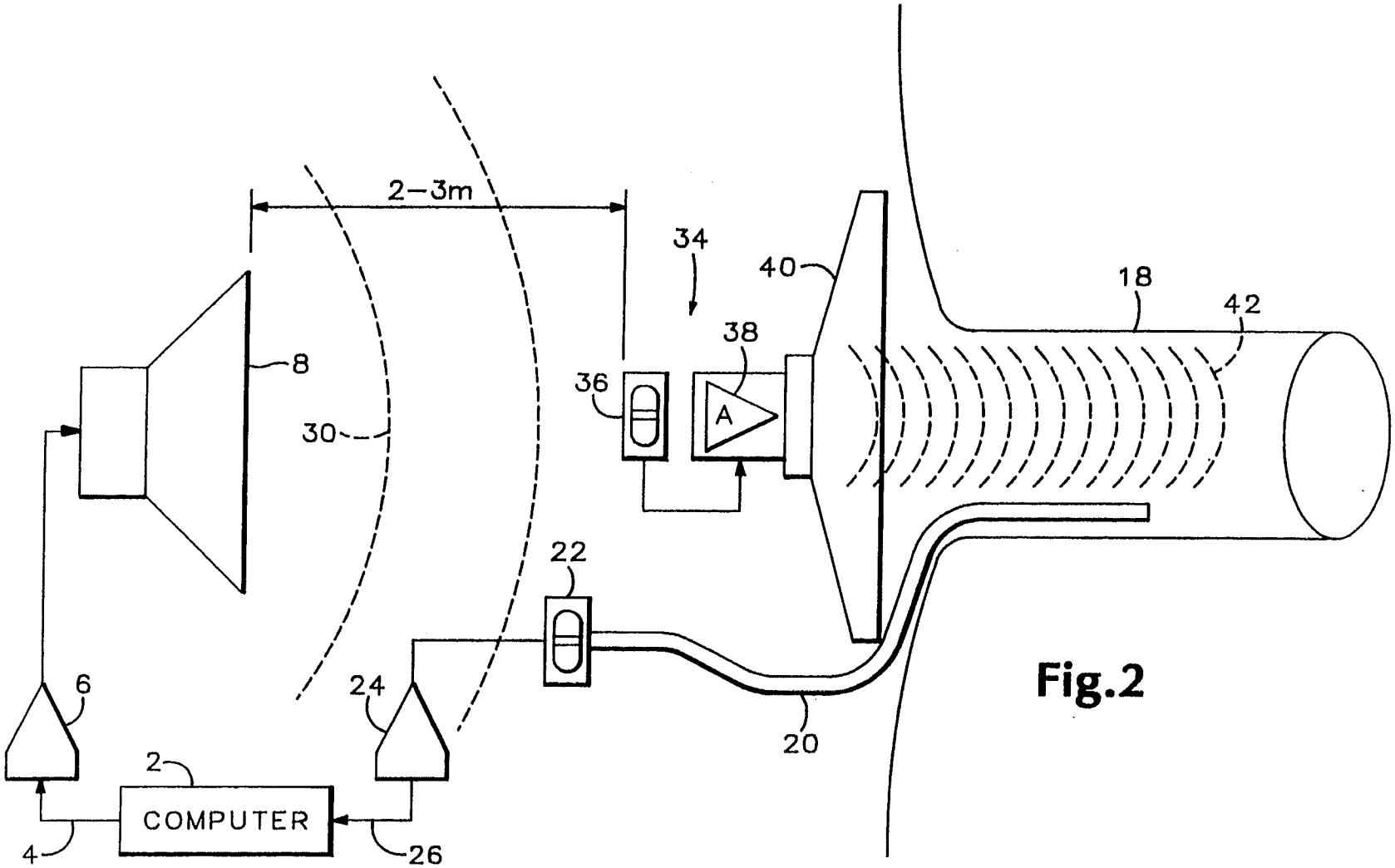
FIG. 2 is a diagram illustrating characterization of a master headset.

FIG. 2 illustrates characterization of a signal path that includes a master hearing prosthesis. In the case illustrated in FIG. 2, the master hearing prosthesis is a master headset 34 that includes a microphone 36 for receiving an acoustic signal, an amplifier 38 that receives the output of microphone 36, and an electro-acoustic transducer 40 that is driven by amplifier 38. The master headset 34 is placed against the coupler 18 in lieu of the target hearing aid 10 so that the transducer 40 generates an acoustic signal 42 in the coupler 18. The system shown in FIG. 2 is used in the manner described with reference to FIG. 1 to derive a transfer function Hb(s), which characterizes the signal path from the output port 4 to the input port 26 by way of the master headset and is equal to Hm(s) * Hr(s), where Hm(s) is the transfer function of the master headset. The function Hb(s) is stored in memory.

Once the transfer functions Ha(s) and Hb(s) are stored in memory, the computer 2 then forms the product Hp(s) of the transfer function Ha(s) and the inverse of the transfer function Hb(s). Since Ha(s) is equal to Ht(s) * Hr(s) and Hb(s) is equal to Hm(s) * Hr(s), Hp(s) is equal to Ht(s)/Hm(s). Thus, the transfer function Hp(s) depends only on the target hearing aid and the master headset.

As discussed with reference to FIG. 3 hereinbelow, in order to replicate the hearing aid filtering action in a dispensing situation, any incoming sound to the patient's ear is conditioned with a real-time hearing aid emulation filter having a transfer function also equal to Hp(s). The real-time hearing aid emulation filter is implemented by running a program on a digital signal processor (DSP), suitably comprising a Motorola 56000 digital signal processor, which may be incorporated within computer 2. The DSP is used to process incoming digitized sound data, producing digital data representing the filtered sounds. The filter program, or algorithm, is custom designed for each hearing aid using the impulse response of the desired transfer function Hp(s).

The impulse response is obtained by computing the inverse fast Fourier Transform, or FFT, of the desired transfer function, Hp(s). The computer decimates the inverse function to return an array of 512 numerical values, and stores the array of numerical values for later use. The resulting 512 impulse response data points become the filter coefficients of a finite impulse response (FIR) filter algorithm that can be run efficiently on the DSP. This operation of determining filter coefficients is repeated for multiple settings of the target hearing aid 10, and for multiple other target hearing aids, providing a plurality of arrays of numerical values, all of which are stored by the computer.

Figure 3:
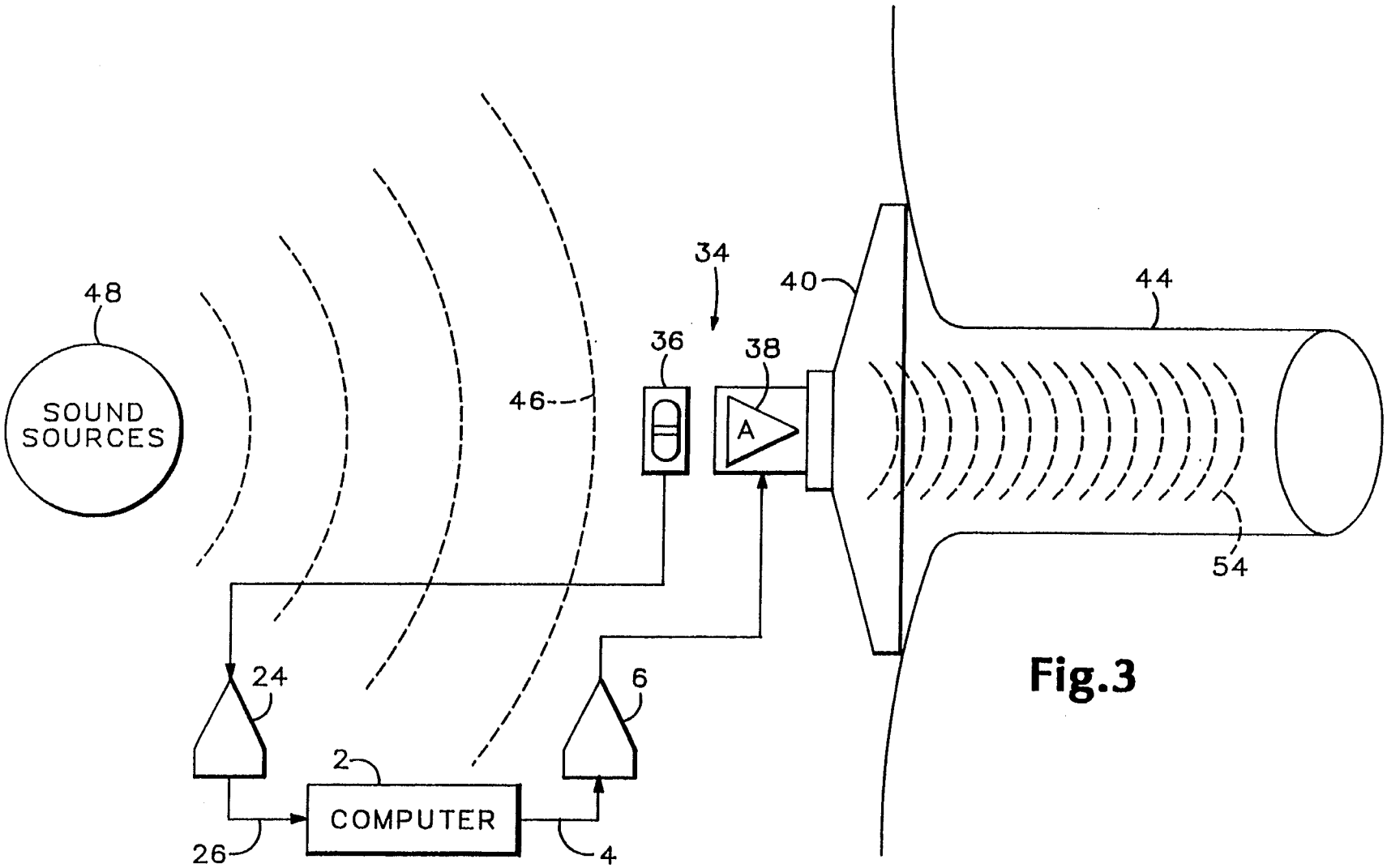
FIG. 3 is a diagram illustrating a hearing aid fitting employing the master headset and the characterizations.

Referring now to FIG. 3, the master headset 34 is placed against a patient's ear 44. The audiologist selects a particular target hearing aid from a menu displayed by the computer and selects a particular setting of that hearing aid from a sub-menu, and the computer reads the corresponding array of numerical values from memory and loads these values into coefficient registers of the digital filter that the digital signal processor implements between the input port 26 and the output port 4 for processing input digital words in order to provide output digital words. A circular buffering technique is used in the DSP whereby a time history of data samples (the number of which is equal to the number of impulse response data points) is kept with new values over-writing the oldest ones. Each data sample in the circular buffer is multiplied by the filter coefficient for that position in the buffer. The products are then weighted and summed together. The transfer function of the digital filter is equal to Hp(s) for the selected target hearing aid at the selected setting.

The master headset microphone 36 receives an incoming acoustic signal 46 produced by a sound source 48. The output of microphone 36 is supplied to A/D converter 24, which supplies a sequence of input digital words to computer 2 by way of input port 26. The digital signal processor filters the input digital words employing the digital filter coefficients created by the computer and provides a filtered sequence of output digital values to D/A converter 6. The analog signal provided by D/A converter 6 is supplied as the input to master headset amplifier 38, which drives transducer 40 to generate an acoustic signal 54 in the patient's ear cavity.

Ignoring the effect of the change in configuration of master headset 34, the transfer function of the signal path from the acoustic side of microphone 36 to the acoustic side of transducer 40 is equal to Hm(s) * Hp(s), which is equal to Ht(s), and so the sound that the patient hears through the master headset is identical to that which would be provided by the selected target hearing aid at the selected setting.

By use of the procedure described with reference to FIGS. 1–3, various target hearing aids may be emulated by making appropriate selections from the menu displayed by the computer. This enables the patient to select the hearing aid that provides the most pleasing performance. Since the patient participates in the fitting procedure by indicating which hearing aid provides the best result, the patient's commitment to the selected hearing aid is enhanced and this may reduce the likelihood of the patient rejecting the hearing aid once the actual device is delivered.

Thus, a real-time digital signal processing system is employed to provide an accurate representation of the hearing aid response that will be experienced by the patient when wearing an actual hearing aid. The hearing aid characterization procedure may be employed to enable hearing aid fitting wherein the hearing aid response is incrementally altered. As each alteration of the filter response occurs, the patient chooses whether the hearing aid sounded better with or without the alteration. The filter may be switched back and forth between responses to allow the patient to identify the best hearing aid and the best setting for the selected hearing aid.

It will be appreciated that the invention is not restricted to the particular embodiment that has been described, and that variations may be made therein without departing from the scope of the invention as defined in the appended claims and equivalents thereof. For example, while FIGS. 2 and 3 illustrate use of a master headset as the master hearing prosthesis, it might be preferred to use a master hearing aid that includes a temporary ear mold as the master hearing prosthesis. Further, while the target hearing aid and the master prosthesis may be characterized in an echo-free sound room, the target hearing aid and master prosthesis may also be characterized under other conditions. This allows the audiologist to present the patient with an emulation of the target hearing aid under those other conditions. For example, by characterizing the target hearing aid and the master prosthesis under conditions that provide reverberation effects it is possible to present a patient who suffers hearing difficulty in an echoing environment with an emulation of the target hearing aid in such an environment.

We claim:

1. A method for fitting a hearing aid to a patient comprising the steps of:

creating a filter having a frequency response dependent on the product of the frequency response of a signal path containing a target hearing aid and the inverse frequency response of said signal path containing a master hearing prosthesis that includes a microphone and an electro-acoustic transducer;

equipping the patient with the master hearing prosthesis;

exposing the microphone of the master hearing prosthesis to an input acoustic signal, whereby the microphone generates an electrical signal; and filtering said electrical signal with said filter and applying the filtered electrical signal to the electro-acoustic transducer, whereby the patient receives an acoustic signal representative of the input acoustic signal modified by the frequency response of the filter.

2. A method according to claim 1, wherein the step of creating the filter comprises:

determining the audio frequency response of a signal path including the target hearing aid;

determining the audio frequency response of a signal path including the master hearing prosthesis; and defining the filter based on the determining steps.

3. A method according to claim 2, wherein the step of determining the audio frequency response of the signal path including said target hearing aid comprises:

applying the hearing aid to a cavity;

exposing the hearing aid to an input acoustic signal; and detecting the acoustic signal generated in the cavity in response to the acoustic signal.

4. A method according to claim 3, further comprising correlating the detected acoustic signal with the input acoustic signal, so as to provide the audio frequency response of the signal path including the hearing aid and the cavity, and storing the provided frequency response.

5. A method according to claim 3, wherein the step of detecting the acoustic signal generated in the cavity comprises:

coupling a microphone to the interior of the cavity; and digitizing the output of the microphone.

6. A method according to claim 2, wherein the step of determining the audio frequency response of the signal path including the master hearing prosthesis comprises:

applying the master hearing prosthesis to a cavity;

exposing the master hearing prosthesis to an input acoustic signal; and detecting the acoustic signal generated in the cavity in response to the acoustic signal.

7. A method according to claim 6, further comprising correlating the detected acoustic signal with the input acoustic signal, so as to provide the audio frequency response of the signal path including the master hearing prosthesis and the cavity, and storing the provided frequency response.

8. A method according to claim 6 wherein the step of detecting the acoustic signal generated in the cavity comprises:

coupling a microphone to the interior of the cavity; and digitizing the output of the microphone.

9. A method according to claim 1, wherein the step of creating the filter comprises:

(a) connecting the target hearing aid in a signal path between an electro-acoustic transducer and an acousto-electric transducer;

(b) applying an electrical signal to the electro-acoustic transducer, whereby the acousto-electric transducer generates an electrical signal that depends on the signal path including the target hearing aid;

(c) correlating the electrical signal generated by the acousto-electric transducer in step (b) with the signal applied to the electro-acoustic transducer in step (b) to derive the transfer function of the signal path including the target hearing aid;

(d) connecting the master hearing prosthesis in the signal path between the electro-acoustic transducer and the acousto-electric transducer;

(e) applying an electrical signal to the electro-acoustic transducer, whereby the acousto-electric transducer generates an electrical signal that depends on the signal path including the master hearing prosthesis; and (f) correlating the electrical signal generated by the acousto-electric transducer in step (e) with the signal applied to the electro-acoustic transducer in step (e) to derive the transfer function of the signal path including the master hearing prosthesis.

10. A method for fitting a hearing aid to a patient comprising the steps of:

creating a first filter having a frequency response dependent on the product of the frequency response of a first target hearing aid and the inverse frequency response of a master hearing prosthesis that includes a microphone and an electro-acoustic transducer;

creating a second filter having a frequency response dependent on the product of the frequency response of a second target hearing aid and the inverse frequency response of said master hearing prosthesis;

exposing the microphone of the master hearing prosthesis to a first input acoustic signal, whereby the microphone generates a first electrical signal;

filtering said first electrical signal with said first filter and applying the filtered electrical signal to the electro-acoustic transducer, whereby the patient receives an acoustic signal representative of the first input acoustic signal modified by the frequency response of the first filter;

exposing the microphone of the master hearing prosthesis to a second input acoustic signal, whereby the microphone generates a second electrical signal; and filtering said second electrical signal with said second filter, whereby the patient receives an acoustic signal representative of the second input acoustic signal modified by the frequency response of the second filter.

11. Apparatus for simulating the performance of a target hearing aid, comprising:

a master hearing prosthesis having a microphone and a speaker; and a filter means having a transfer function substantially equal to the product of the transfer function of a signal path including the target hearing aid and the inverse transfer function of a signal path including the master hearing prosthesis, said filter means being connected between the microphone of the master hearing prosthesis and the speaker thereof, whereby the combined transfer function of the master hearing prosthesis and the filter means is substantially equal to the transfer function of the target hearing aid.

12. Apparatus according to claim 11, wherein the filter means comprises an A/D converter for converting an analog output signal provided by the microphone to digital form, a digital signal processing means for processing the digital signal provided by the A/D converter, and a D/A converter for converting the processed digital signal to analog form and providing the analog signal to the speaker.

13. Apparatus according to claim 11, wherein said filter means is created by a method comprising the following steps:

(a) connecting the target hearing aid in a signal path between an electro-acoustic-transducer and an acousto-electric transducer;

(b) applying an electrical signal to the electro-acoustic transducer, whereby the acousto-electric transducer generates an electrical signal that depends on the signal path including the target hearing aid;

(c) correlating the electrical signal generated by the acousto-electric transducer in step (b) with the signal applied to the electro-acoustic transducer in step (b) to derive the transfer function of the signal path including the target hearing aid;

(d) connecting the master hearing prosthesis in the signal path between the electro-acoustic transducer and the acousto-electric transducer;

(e) applying an electrical signal to the electro-acoustic transducer, whereby the acoustic-electric transducer generates an electrical signal that depends on the signal path including the master hearing prosthesis;

(f) correlating the electrical signal generated by the acousto-electric transducer in step (e) with the signal applied to the electro-acoustic transducer in step (e) to derive the transfer function of the signal path including the master hearing prosthesis; and (g) forming the product of the transfer function of the signal path including the target hearing aid and the inverse transfer function of the signal path including the master hearing prosthesis.

14. A method for fitting a hearing aid to a patient, said method comprising:

(a) connecting a first target hearing prosthesis in a signal path between an electro-acoustic transducer and an acousto-electric transducer, for signal flow from the electro-acoustic transducer, through the first hearing prosthesis, to the acousto-electric transducer;

(b) applying an electrical signal to the electro-acoustic transducer, whereby the acousto-electric transducer generates an electrical signal that depends on the signal path including the first hearing prosthesis;

(c) correlating the electrical signal generated by the acousto-electric transducer in step (b) with the signal applied to the electro-acoustic transducer in step (b) to derive the transfer function of the signal path including the first hearing prosthesis;

(d) connecting a second hearing prosthesis in the signal path between the electro-acoustic transducer and the acousto-electric transducer, for signal flow from the electro-acoustic transducer, through the second hearing prosthesis, to the acousto electric transducer;

(e) applying an electrical signal to the electro-acoustic transducer, whereby the acousto-electric transducer generates an electrical signal that depends on the signal path including the second hearing prosthesis;

(f) correlating the electrical signal generated by the acousto-electric transducer in step (e) with the signal applied to the electro-acoustic transducer in step (e) to derive the transfer function of the signal path including the second hearing prosthesis;

(g) connecting a master hearing aid that includes a microphone and a speaker in the signal path between the electro-acoustic transducer and the acousto-electric transducer;

(h) applying an electrical signal to the electro-acoustic transducer, whereby the acousto-electric transducer generates an electrical signal that depends on the signal path including the master hearing aid;

(i) correlating the electrical signal generated by the acousto-electric transducer in step (h) with the signal applied to the electro-acoustic transducer in step (h) to derive the transfer function of the signal path including the master hearing aid;

(j) creating a first filter of which the transfer function depends on the product of the frequency response of the signal path containing the first target hearing aid and the inverse transfer function of the signal path including the master hearing aid;

(k) creating a second filter of which the transfer function depends on the product of the frequency response of the signal path containing the second target hearing aid and the inverse transfer function of the signal path including the master hearing aid;

(l) equipping the patient with the master hearing aid;

(m) exposing the microphone of the master hearing aid to an input acoustic signal, whereby the microphone generates an electrical signal; and (n) filtering said electrical signal alternatively with the first filter and the second filter and applying the filtered electrical signal to the speaker of the master hearing aid, whereby the master hearing aid and the first and second filters alternatively emulate the first target hearing aid and the second target hearing aid.

* * * * *